US005373656A

United States Patent [19]

Merser

[11] Patent Number: 5,373,656

[45] Date of Patent: Dec. 20, 1994

[54] CLOTHING TAG AND METHOD OF USE

[75] Inventor: F. Gerard Merser, Round Pond, Me.

[73] Assignee: Avery Dennison Corporation, Pasadena, Calif.

[21] Appl. No.: 945,211

[22] Filed: Sep. 17, 1992

[51] Int. Cl.[5] ..... G09F 3/08

[52] U.S. Cl. ..... 40/663; 40/668; 206/807

[58] Field of Search ..... 40/299, 662, 663, 664, 40/669, 668, 630, 631, 661.6; 283/100, 101, 106; 24/72.7, 704.1, 711.1; 206/806, 807

[56] References Cited

U.S. PATENT DOCUMENTS

| | | | |
|---|---|---|---|
| 3,130,509 | 4/1964 | Brooks | 40/662 |
| 3,429,064 | 2/1969 | Davi | 24/711.1 |
| 3,765,110 | 10/1973 | Olsen | 40/663 |
| 4,020,575 | 5/1977 | Kruger et al. | 40/669 |
| 4,155,183 | 5/1974 | Abrahams | 40/1.5 |
| 4,189,049 | 2/1980 | Silver | 206/806 X |
| 4,722,376 | 2/1988 | Rhyner | 40/1.5 X |
| 5,018,286 | 5/1991 | Zahner | 40/299 |

*Primary Examiner*—Brian K. Green
*Attorney, Agent, or Firm*—Kriegsman & Kriegsman

[57] ABSTRACT

A tag adapted to be attached to an article of clothing or the like with a fastener of the type comprising an elongated plastic member having a cross-bar at one end. In one embodiment, the tag comprises a sheet of material folded and sealed to define a pocket, the pocket being provided with an opening through which a cross-bar may be inserted. Both the pocket and the opening are appropriately sized and shaped so that, when a cross-bar of a fastener is inserted into the pocket through the opening, the cross-bar cannot easily be removed from the pocket without tampering with the pocket in a readily identifiable manner. The tag may be attached to an article of clothing in such a way as to make removal of the tag from the article of clothing and subsequent re-attachment of the tag to the article of clothing difficult to accomplish without providing evidence of tampering by inserting the cross-bar of a fastener comprising an elongated plastic member having a cross-bar at one end and a paddle at the opposite end first through the article of clothing and then into the pocket of the tag through the opening. In a second embodiment, the pocket of the tag is provided with a pair of openings so that the tag may be used with a fastener of the type comprising an elongated V-shaped plastic member having a first cross-bar at one end and a second cross-bar at a second end.

2 Claims, 8 Drawing Sheets

CLOTHING TAG AND METHOD OF USE

BACKGROUND OF THE INVENTION

The present invention relates generally to clothing tags and more particularly to a novel clothing tag and method of use.

The practice of attaching tags to articles of clothing and the like by means of plastic fasteners of the type comprising an elongated plastic member having a cross-bar at one end, a paddle at the opposite end, and a filament interconnecting the cross-bar and the paddle is well known. Such tags typically comprise a generally-rectangular sheet of tagstock or tagboard provided with a hole, the tag typically being attached to the article of clothing by inserting the cross-bar end of the plastic fastener first through the hole in the tag and then through the article of clothing using a device commonly referred to as a tagger gun. With the cross-bar end of the fastener thus attached to the article, the paddle end of the fastener serves to keep the tag from being pulled off the filament portion of the fastener. Information relating to the name of the manufacturer, the name of the retailer, the price of the article, or the like is typically printed on the tag.

One problem that has arisen with the use of such tags, particularly in connection with the sale of articles of clothing, is that certain unscrupulous consumers have made a practice of purchasing an expensive or unusual article of clothing, removing those tags attached to the garment (the tags often being conspicuously placed on the article), wearing the article of clothing once or twice, and then returning the article of clothing to the retailer for a refund. Because of the administrative difficulties associated with determining which consumers have legitimate reasons for returning their articles of clothing and which consumers are looking for refunds for worn articles of clothing, many retailers are effectively forced to issue refunds to all those who request such. As can readily be appreciated, this can result in considerable losses for the retailer as many of the worn and returned articles of clothing are no longer in new condition and cannot be re-sold for their original prices.

One approach that has been taken by some retailers to discourage consumers from wearing and then returning articles of clothing as described above has been to attach an additional tag to the article of clothing in the same manner as described above, the tag containing a warning to the consumer that removal thereof precludes the possibility of a refund for the article. Such tags are typically placed on the article of clothing in a conspicuous location so that the consumer will not want to wear the article without removing the tag. This approach, however, has not been entirely satisfactory since some consumers have discovered how to remove the fastener attaching the tag to the article of clothing in such a way as to enable the fastener and tag to be manually re-attached to article of clothing by the consumer at a later date without clearly evidencing signs of removal and re-attachment. Typically, such removal of the fastener from the article is accomplished by positioning the cross-bar so that it is parallel to the filament (i.e., by pulling on the cross-bar to create some slack in the filament and then bending the end of the filament adjacent to the cross-bar so that the cross-bar is aligned with the remainder of the filament) and then by pushing the cross-bar and the filament back through the same opening in the article of clothing through which they were originally inserted. Re-attachement of the fastener and tag to the article of clothing may then be accomplished as described above by re-inserting the cross-bar end of the fastener through the article of clothing.

Accordingly, it would clearly be desirable to have a tag which could be attached to an article of clothing or the like by means of a plastic fastener in such a way as to make removal of the tag from the article of clothing and re-attachment of the tag to the article of clothing difficult to accomplish without providing some evidence of tampering.

SUMMARY OF THE INVENTION

It is an object of the present invention to provide a novel clothing tag and method of using the same.

Accordingly, a clothing tag for use with a fastener of the type comprising an elongated member having a cross-bar at one end, the clothing tag comprising one or more sheets of material arranged to define a pocket, said pocket having an opening through which a cross-bar may be inserted, said pocket and said opening being appropriately sized and shaped so that, when a cross-bar of a fastener is inserted into said pocket through said opening, the cross-bar cannot easily be removed from said pocket without tampering with said pocket in a readily identifiable manner.

The above-described clothing tag may be attached to an article of clothing in such a way as to make removal of the clothing tag from the article of clothing and subsequent re-attachment of the tag to the article of clothing difficult to accomplish without providing some evidence of tampering. According to one embodiment, this is achieved by attaching the above-described clothing tag to an article of clothing using a fastener of the type comprising an elongated member having a cross-bar at one end and a paddle or the like at the opposite end. The cross-bar of the fastener is first inserted through the article of clothing and is then inserted into the pocket of the tag through the opening provided therein. The paddle end of the fastener is not insertable through the article of clothing and prevents the fastener from being pulled completely through the article of clothing.

In another embodiment of the invention, the pocket is provided with a pair of openings, each opening being sized and shaped so that a cross-bar of a fastener inserted therethrough into the pocket cannot easily be removed from said pocket without tampering with said pocket in a readily identifiable manner. Such a clothing tag also may be attached to an article of clothing in such a way as to make removal and subsequent re-attachment thereof difficult to accomplish without providing evidence of tampering. According to one embodiment, this is achieved by attaching the clothing tag to an article of clothing using a fastener of the type comprising an elongated V-shaped member having a first cross-bar at a first end and a second cross-bar at a second end. The pair of cross-bars of the fastener may be inserted directly through the article of clothing and then inserted into the pocket through the corresponding pair of openings; alternatively, to avoid creating a pair of holes in the article of clothing as a result of inserting the pair of cross-bars of the fastener directly through the article of clothing, one of the cross-bars of the fastener may be inserted, for example, through the loop defined by a belt loop or through a button-hole or the like and then inserted into the pocket through one of the cross-bar openings, with the other cross-bar being drawn around the article of clothing and then inserted into the pocket through the other cross-bar opening.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
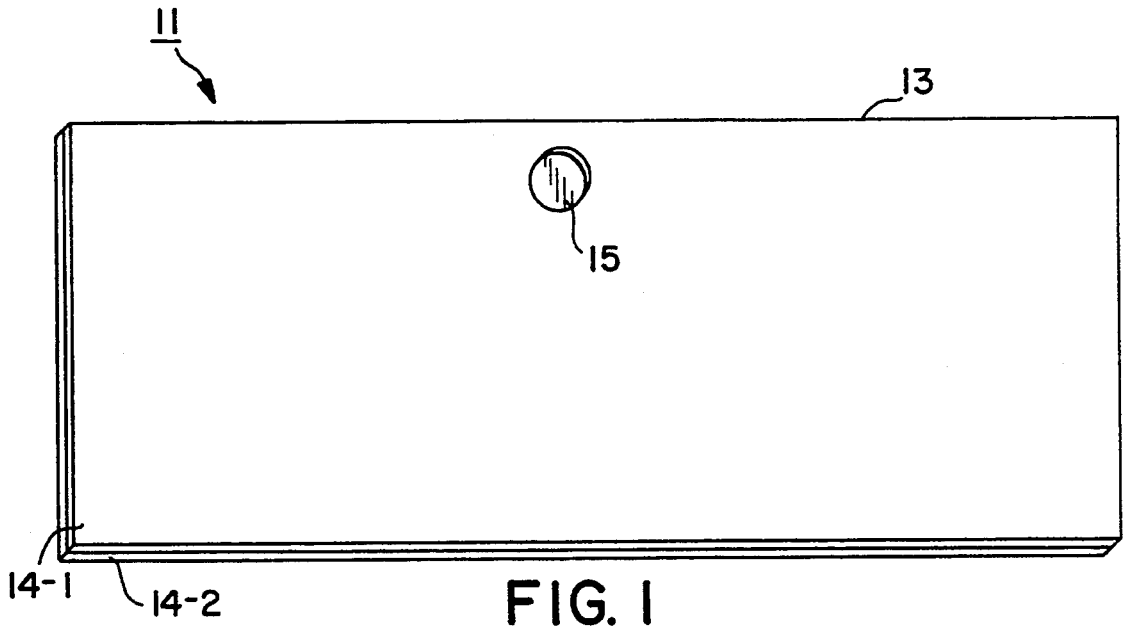
FIG. 1 is a top perspective view of one embodiment of a clothing tag constructed according to the teachings of the present invention.

Referring now to FIG. 1, there is shown one embodiment of a clothing tag constructed according to the teachings of the present invention, the clothing tag being represented generally by reference numeral 11.

Figure 2:
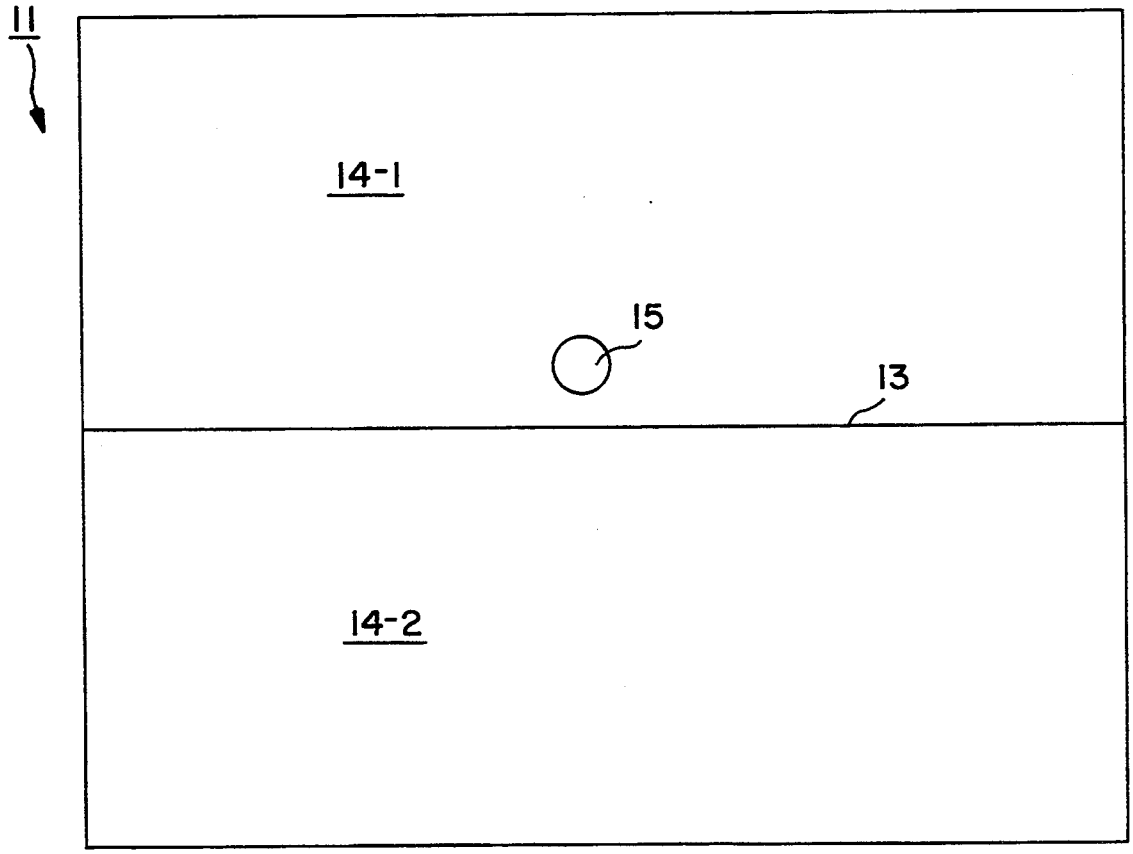
FIG. 2 is a plan view of the sheet of material used to make the clothing tag shown in FIG. 1.

As can be seen in FIG. 2, tag 11 is formed from a generally rectangular sheet of material, the sheet of material being provided with a fold line 13 for defining a pair of equally dimensioned sections 14-1 and 14-2. The sheet of material is also provided with an opening 15, which is appropriately sized and shaped so that the sheet of material may be securely attached to a fastener of the type having a cross-bar at one end by inserting the cross-bar of the fastener through opening 15. In the present embodiment, opening 15 is located off to one side of fold line 13, as opposed to being located along fold line 13, so that, when the sheet of material is folded and sealed to form tag 11, opening 15 may be easily aligned with the cross-bar that is to be inserted therethrough.

Figure 3:
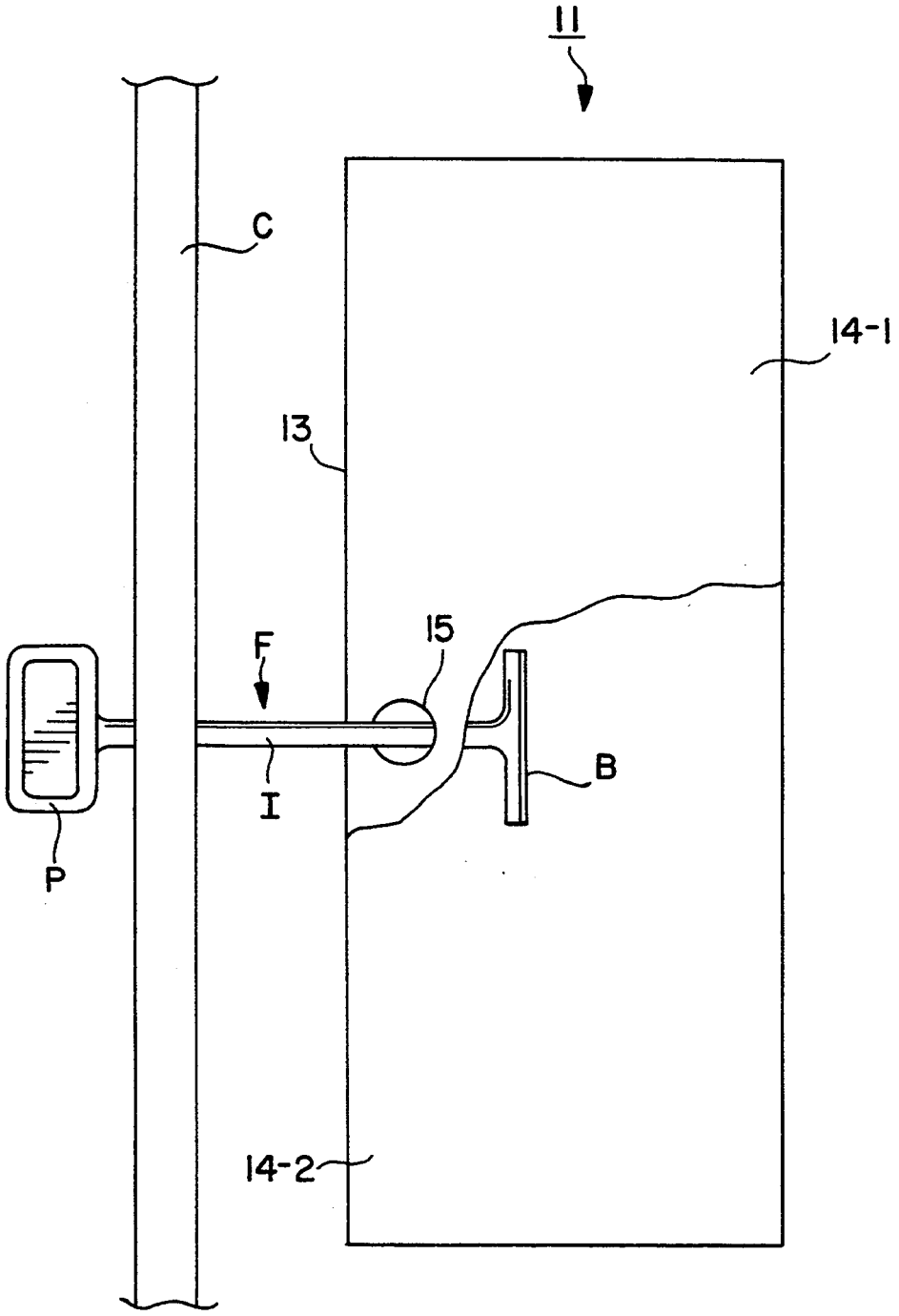
FIG. 3 is a top view, broken away in part, illustrating how the clothing tag of FIG. 1 may be attached to an article of clothing in such a way as to make removal from the article of clothing and subsequently re-attachment thereto difficult to accomplish without providing some evidence of tampering.

To construct tag 11, the sheet of material shown in FIG. 2 is folded along fold line 13, and the corresponding outer edges of sections 14-1 and 14-2 are sealed together to form a pocket (as can be seen best in FIG. 3). In the present embodiment, the sheet of material is made from a heat-sealable subtance or the like so that extraneous fastening or adhesive materials are not needed to seal together sections 14-1 and 14-2. Examples of suitable materials for this purpose include heat-sealable plastics. For reasons to be discussed below, heat-sealable plastics which are transparent, such as clear polyethylenes, acetates, and polyester films of the type sold under the trademark Mylar, are preferred.

Tag 11 may be labelled with a warning to consumers that removal thereof from the article to which it is attached precludes return of the article and/or may be labelled with other pertinent retail information.

To attach tag 11 to a fastener having a cross-bar at one end, one merely has to insert the cross-bar of the fastener into tag 11 through opening 15. This may be done either manually or using a tagging gun which has been loaded with the fastener. To use a tagging gun loaded with the fastener, the needle of the tagging gun is inserted through opening 15, and the gun is fired, whereby the cross-bar of the fastener is ejected from the needle through opening 15. As can readily be appreciated, because of the construction of tag 11, once a cross-bar of a fastener has been inserted thereinto, it cannot easily be removed therefrom without tampering with tag 11 in a readily identifiable manner. For example, if one tries to remove the cross-bar either (1) by enlarging opening 15 so that the cross-bar can be easily withdrawn therethrough or (2) by creating an additional opening in tag 11 through which the cross-bar can be accessed, the appearance of tag 11 will be altered in a manner that can be readily ascertained.

Referring now to FIG. 3, there is shown an arrangement wherein tag 11 is attached to an article of clothing C in such a way that it cannot easily be removed from clothing C and subsequently re-attached thereto without providing some evidence of tampering. As can be seen, this arrangement involves using a fastener F of the type comprising an elongated plastic member having a cross-bar B at one end, a paddle P at the opposite end, and a filament I interconnecting cross-bar B and paddle P. To attach tag 11 to clothing C in the manner shown, cross-bar B is first inserted through clothing C and then into tag 11 through opening 15 by means of a tagging gun or the like. Paddle P is appropriately sized and shaped to prevent fastener F from being drawn completely through clothing C.

As can readily be appreciated, with cross-bar B thus inserted into tag 11, tag 11 cannot be removed from clothing C and later re-attached thereto without showing some signs of tampering. This is in part because paddle P, unless tampered with in a perceptible manner, cannot be manipulated and pulled through clothing C and in part because tag 11 cannot easily be removed from and re-attached to fastener F without causing perceptible damage to tag 11. Should tag 11 be removed from an article of clothing by severing filament I (whereby its corresponding cross-bar is left inside tag 11) and then later re-attached to the article of clothing by inserting the cross-bar of a second fastener into tag 11 through opening 15, the presence of the additional cross-bar within tag 11 will indicate tampering. To facilitate detection of an additional cross-bar inside of tag 11, tag 11 is preferably made of a transparent material.

Figure 4:
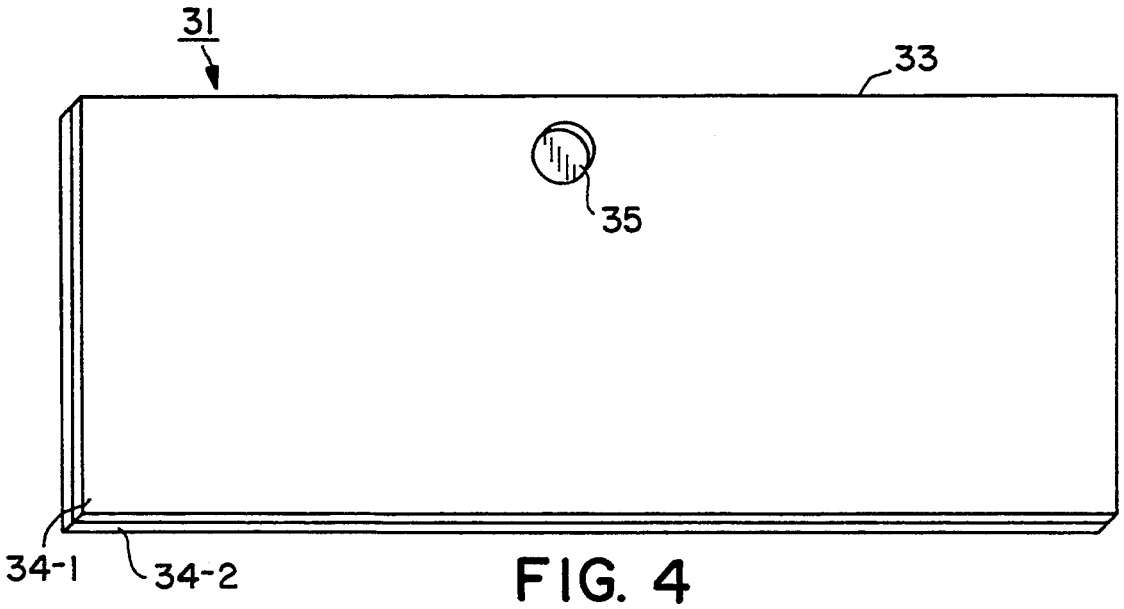
FIG. 4 is a top perspective view of a second embodiment of a clothing tag constructed according to the teachings of the present invention.

Referring now to FIG. 4, there is shown a second embodiment of a clothing tag constructed according to the teachings of the present invention, the clothing tag being represented generally by reference numeral 31.

Figure 5:
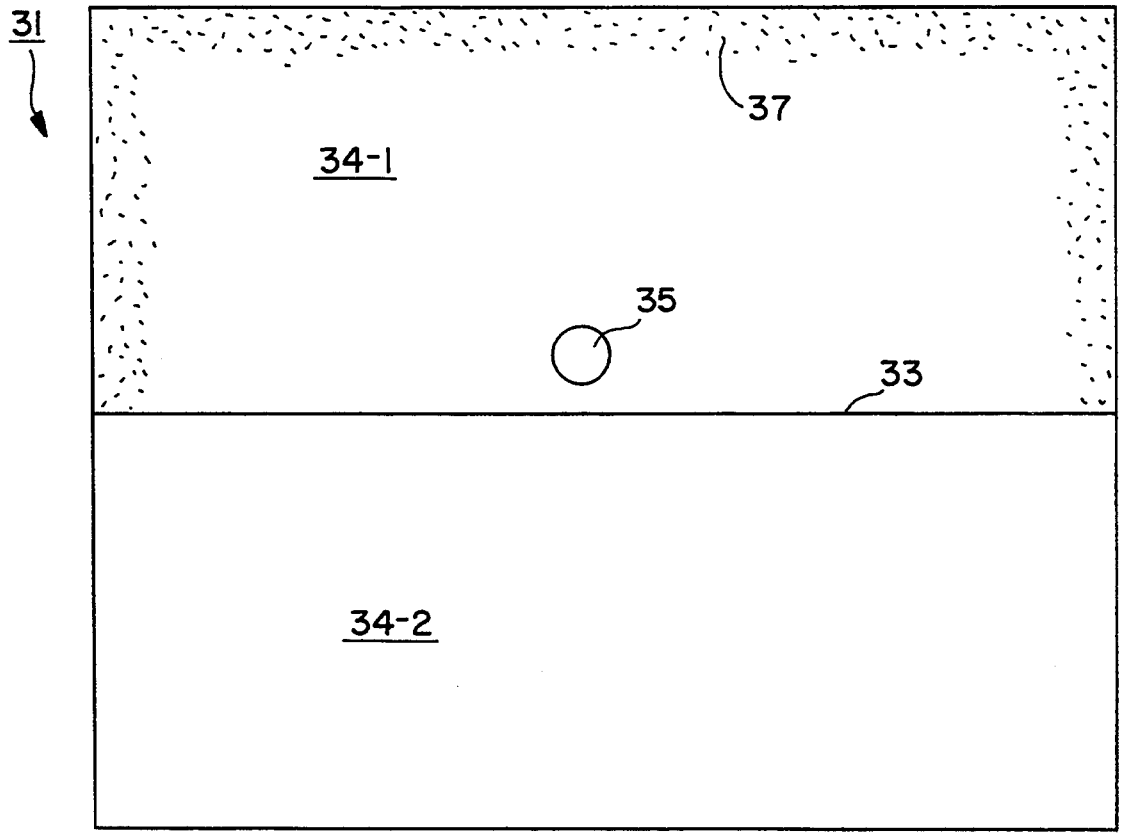
FIG. 5 is a plan view of the sheet of material used to make the clothing tag shown in FIG. 4 as it appears after adhesive has been applied thereto.

As can be seen in FIG. 5, tag 31 is very similar in construction to tag 11, tag 31 also comprising a sheet of material having a fold line 33 for defining a pair of equally dimensioned sections 34-1 and 34-2 and an opening 35 through which a cross-bar of a fastener may be inserted for attaching the sheet of material to the fastener. The principal difference between tag 31 and tag 11 is that tag 31 includes an amount of adhesive material 37 adhered to section 34-1 along its outer edges, adhesive material 37 being used to seal together the respective outer edges of sections 34-1 and 34-2 to form a pocket. Because an extraneous adhesive is used to seal together sections 34-1 and 34-2, tag 31 need not be constructed from heat-sealable materials; accordingly, materials, such as cardboard, tagboard, and the like, may also be used.

Figure 6:
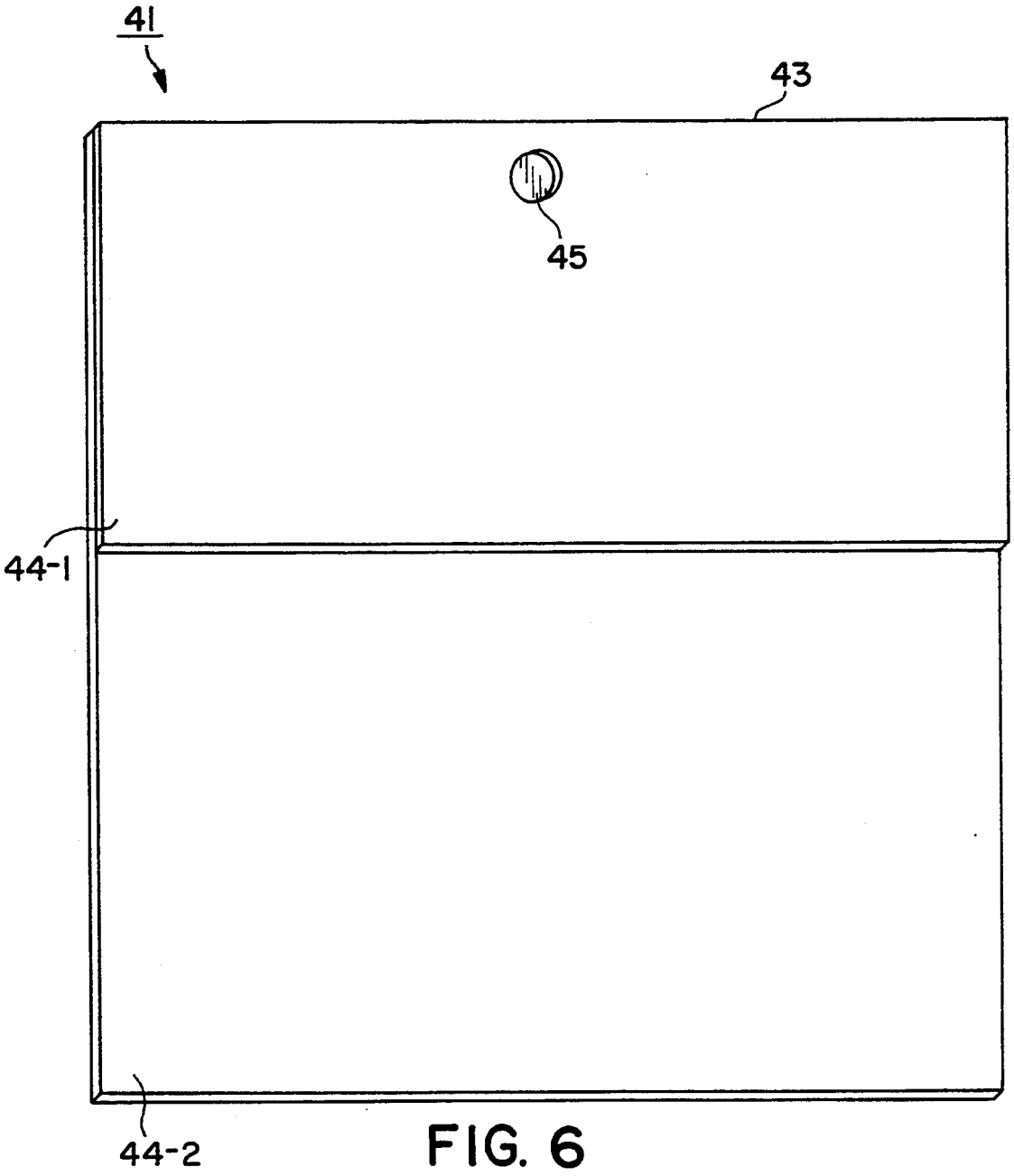
FIG. 6 is a top perspective view of a third embodiment of a clothing tag constructed according to the teachings of the present invention.

Referring now to FIG. 6, there is shown a third embodiment of a clothing tag constructed according to the teachings of the present invention, the clothing tag being identified generally by reference numeral 41.

Figure 7:
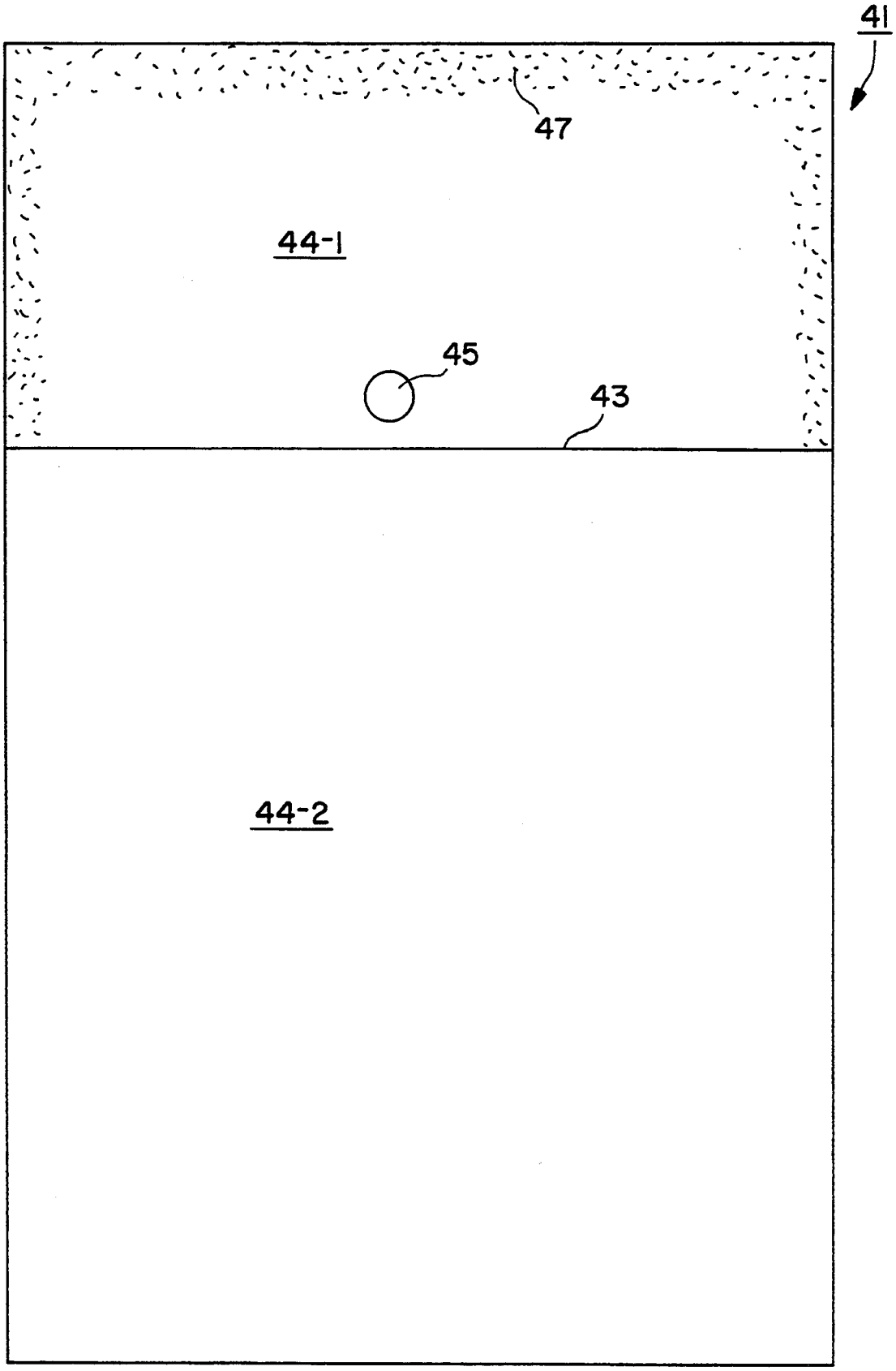
FIG. 7 is a plan view of the sheet of material used to make the clothing tag shown in FIG. 4 as it appears after adhesive has been applied thereto.

As can be seen in FIG. 7, tag 41 is very similar in construction to tag 31, tag 41 also comprising a sheet of material having a fold line 43 for defining a pair of sections 44-1 and 44-2, an opening 45 through which a cross-bar of a fastener may be inserted for attaching the sheet of material to the fastener, and an amount of adhesive material 47 adhered to section 44-1 along its outer edges for sealing together sections 44-1 and 44-2. Tag 41 differs from tag 31 in that sections 44-1 and 44-2 of tag 41 are equal in length but not equal in width whereas sections 34-1 and 34-2 of tag 31 are equal in length and width. Accordingly, as can be seen in FIG. 6, when sections 44-1 and 44-2 are brought together to form a pocket, a portion of section 44-2 is left uncovered by section 44-1. This portion of section 44-2 may be used to display a warning of the type described above or to display other pertinent retail information.

Figure 8:
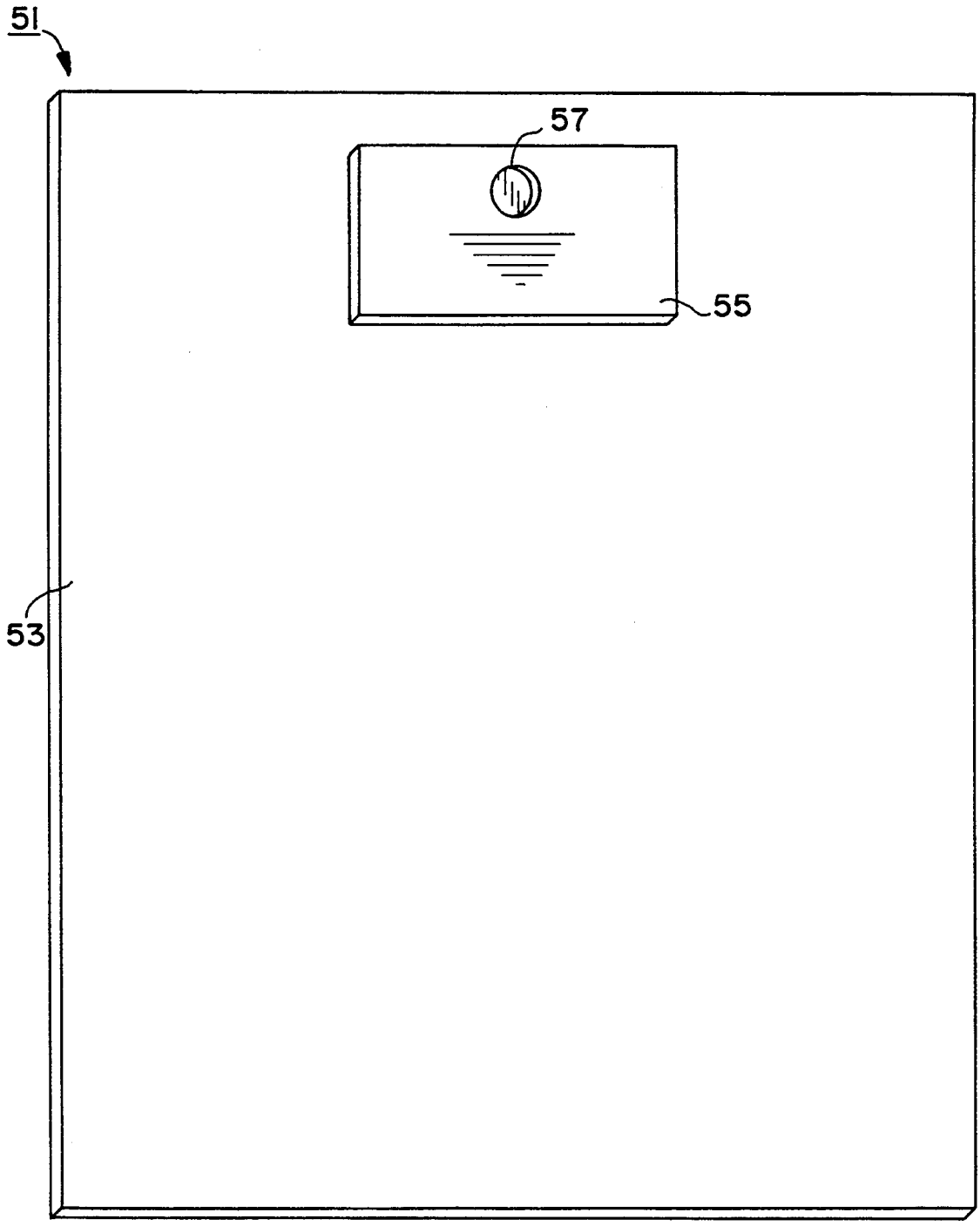
FIG. 8 is a top perspective view of a fourth embodiment of a clothing tag constructed according to the teachings of the present invention.

It should be understood that, instead of using a single sheet of material to construct the clothing tag of the present invention, one could use two or more sheets of material properly arranged. One example of such an arrangement involving two or more sheets of material can be seen in FIG. 8, where a clothing tag 51 having a blister pack-type construction is shown. In the embodiment shown, clothing tag 51 comprises a sheet of backing 53, made of fiberboard, tagstock or the like, and a sheet of transparent heat-sealable plastic 55 having an appropriately sized opening 57. Plastic sheet 55 is heat-sealed to backing 53 to form a pocket of appropriate size and shape. Plastic sheet 55 may be dimensioned to cover the entirety of backing 53 or may be dimensioned to cover just a portion of backing 53 (as presently shown) to conserve material and to provide a space upon which pertinent information may be displayed as described above in connection with tag 41.

Figure 9:
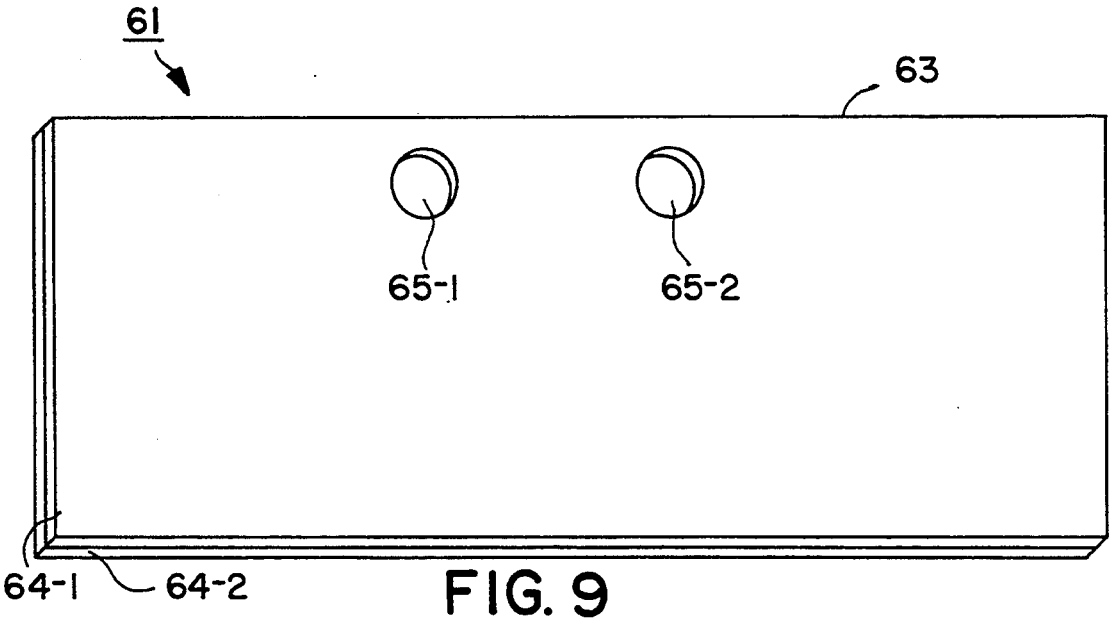
FIG. 9 is a top perspective view of a fifth embodiment of a clothing tag constructed according to the teachings of the present invention.

Referring now to FIG. 9, there is shown a fifth embodiment of a clothing tag constructed according to the teachings of the present invention, the clothing tag being represented generally by reference numeral 61.

Figure 10:
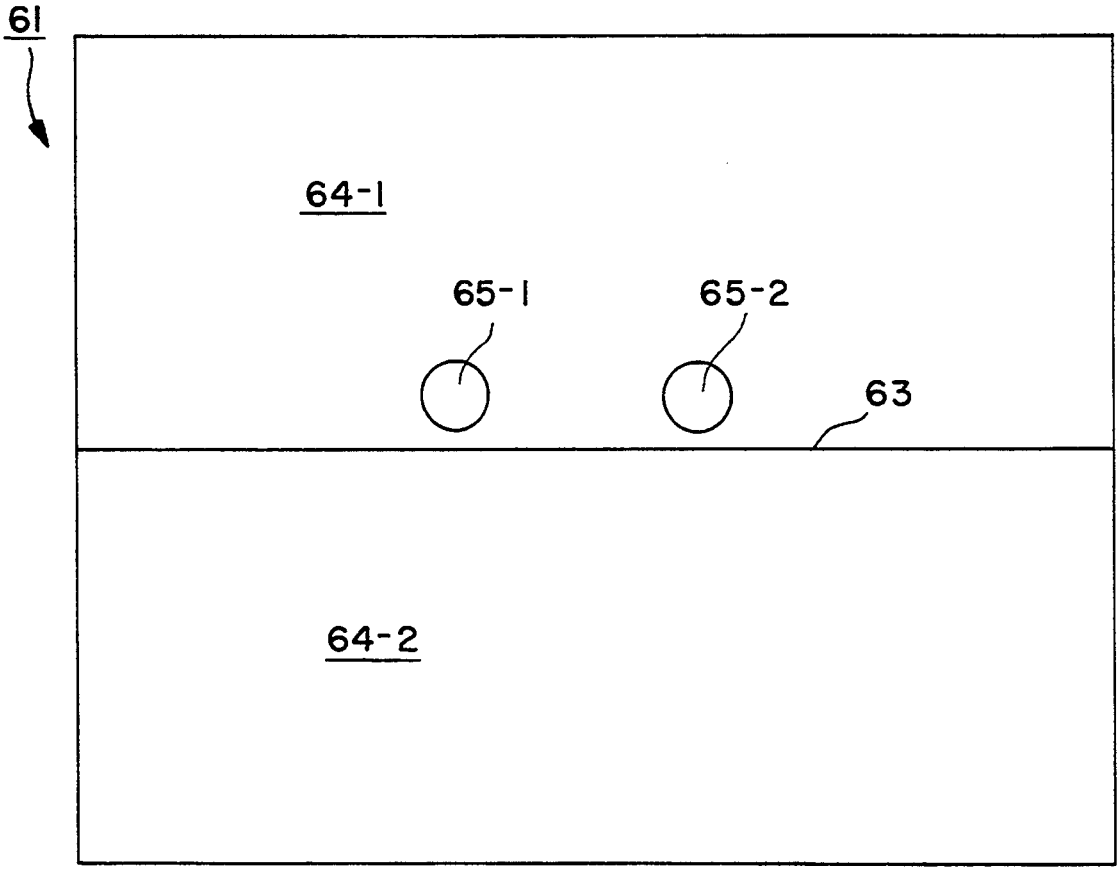
FIG. 10 is a plan view of the sheet of material used to make the clothing tag shown in FIG. 9.

As can be seen in FIG. 10, tag 61 is very similar in construction and composition to tag 11, tag 61 also comprising a sheet of material having a fold line 63 for defining a pair of equally dimensioned sections 64-1 and 64-2. The principal difference between tag 61 and tag 11 is that 61 includes a pair of openings 65-1 and 65-2, respectively, through which a cross-bar of a fastener may be inserted for attaching the sheet of material to the fastener.

Figure 11:
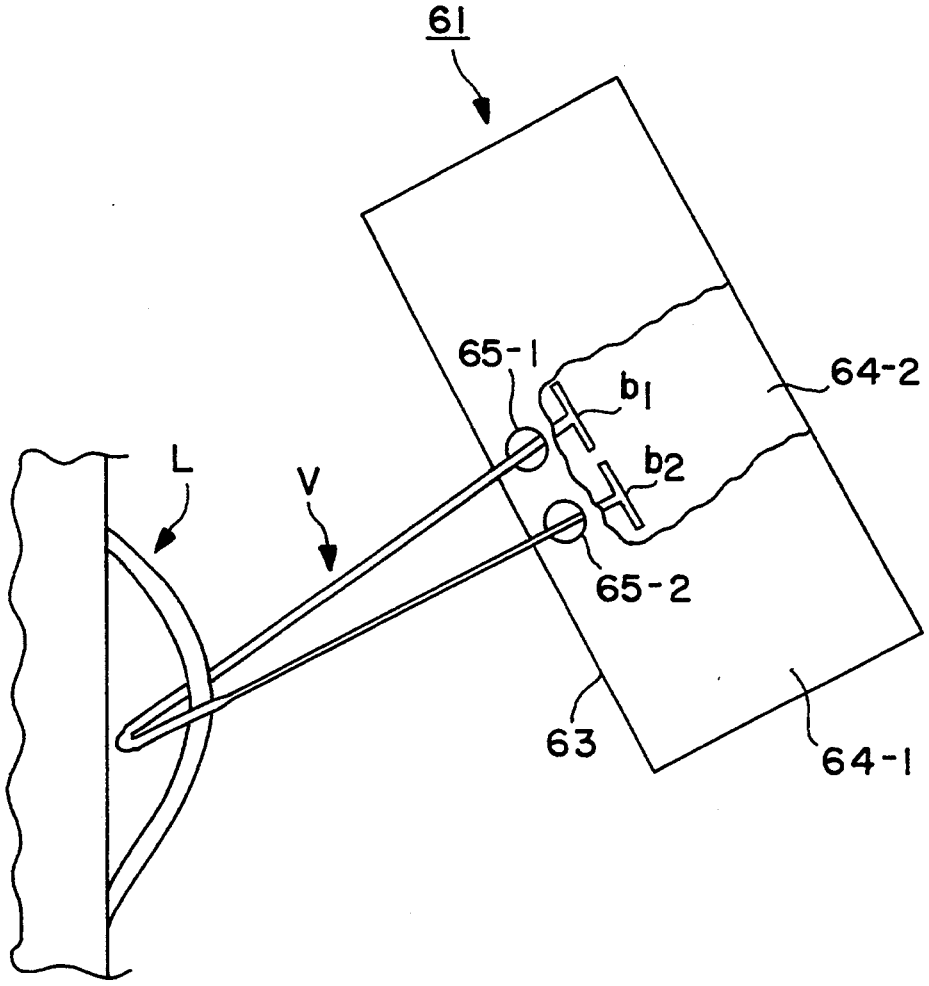
FIG. 11 is a top view, broken away in part, illustrating how the clothing tag of FIG. 9 may be attached to an article of clothing in such a way as to make removal from the article of clothing and subsequent re-attachement thereto difficult to accomplish without providing some evidence of tampering.

As can be seen in FIG. 11, tag 61 is particularly well-suited for use with a fastener V of the type comprising a V-shaped plastic member having a first cross-bar $b_1$ at one end and a second cross-bar $b_2$ at another end. Tag 61 may be attached to an article of clothing in such a way as to provide evidence of removal therefrom and subsequent re-attachment thereto by insertion of cross-bars $b_1$ and $b_2$ directly through the article of clothing and into openings 65-1 and 65-2, respectively; alternatively, as is shown in FIG. 11, one cross-bar may be inserted through the loop defined by a belt-loop L (or through a button-hole or the like) and into tag 61 through one of openings 65 and the other cross-bar drawn around the article of clothing and inserted into tag 61 through the other of openings 65. As can readily be appreciated, the latter arrangement avoids creating any new holes in the article of clothing.

It should be understood that, while the tag of the present invention has been described above as being adapted for attachment to articles of clothing, the present tag is not limited to attachment to articles of clothing and may be used with any similar article of commerce.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A method of attaching a tag to an article of clothing in such a way as to make removal of the tag from the article of clothing and subsequent re-attachment of the tag to the article of clothing difficult to accomplish without providing some evidence of tampering, the method comprising the steps of (a) providing a fastener comprising an elongated member having a first end shaped to define a cross-bar and a second end not insertable through the article of clothing, (b) providing a tag comprising one or more sheets of material arranged to define a pocket, said pocket being provided with an opening through which a cross-bar may be inserted, said pocket and said opening being appropriately sized and shaped so that, when a cross-bar of a fastener is inserted into said pocket through said opening, the cross-bar cannot easily be removed from said pocket without tampering with said pocket in a readily identifiable manner, and (c) then, inserting said cross-bar of said fastener first through the article of clothing and then into said pocket of said tag through said opening.

2. A method of attaching a tag to an article of clothing in such a way as to make removal of the tag from the article of clothing and subsequent re-attachment of the tag to the article of clothing difficult to accomplish without providing some evidence of tampering, the article of clothing being provided with a hole or loop, the method comprising the steps of (a) providing a fastener comprising an elongated V-shaped member having a first end shaped to define a first cross-bar and a second end shaped to define a second cross-bar, (b) providing a tag comprising one or more sheets of material arranged to define a pocket, said pocket being provided with a pair of openings through which said first cross-bar and said second cross-bar, respectively, of said fastener may be inserted, said pocket and said pair of openings being appropriately sized and shaped so that, when said first cross-bar and said second cross-bar of said fastener are inserted into said pocket through said pair of openings, neither of said first cross-bar or said second cross-bar can easily be removed from said pocket without tampering with said pocket in a readily identifiable manner, (c) inserting said first cross-bar of said fastener first through the hole or loop provided in the article of clothing and then into said pocket of said tag through one of said pair of openings, and (d) drawing said second cross-bar of said fastener around the article of clothing and then into said pocket of said tag through the other of said pair of openings.

* * * * *